United States Patent [19]

Lehtinen

[11] 4,391,672

[45] Jul. 5, 1983

[54] METHOD USED IN PAPER MAKING FOR TREATMENT OF A WEAVE

[75] Inventor: Antti Lehtinen, Jyväskylä, Finland

[73] Assignee: Valmet Oy, Finland

[21] Appl. No.: 279,748

[22] Filed: Jul. 2, 1981

[30] Foreign Application Priority Data

Mar. 16, 1981 [FI] Finland ..... 810812

[51] Int. Cl.[3] ..... D21F 7/00

[52] U.S. Cl. ..... 162/192; 162/199; 162/274; 68/3 SS; 134/1

[58] Field of Search ..... 162/192, 199, 274; 366/127; 68/3 SS; 134/1

[56] References Cited

U.S. PATENT DOCUMENTS

| | | | |
|---|---|---|---|
| 2,967,119 | 1/1961 | Gutterman | 68/3 SS |
| 3,712,085 | 1/1973 | Guberman et al. | 68/3 SS |
| 3,829,328 | 8/1974 | Blustain | 134/1 |

FOREIGN PATENT DOCUMENTS

| | | | |
|---|---|---|---|
| 636049 | 6/1978 | U.S.S.R. | 134/1 |

*Primary Examiner*—William F. Smith

*Attorney, Agent, or Firm*—Steinberg & Raskin

[57] ABSTRACT

Ultrasonic frequency sensor/radiators (hereinafter, radiators) are arranged in the vicinity of a material to be treated, on opposite sides of such material, opposite each other. In one embodiment, longitudinal acoustic vibrations are fed to the radiators at the same frequency and the phase difference of the vibrations fed to the different radiators is varied. In another embodiment, the vibrations are fed to the radiators at different frequencies $f_1$ and $f_2$ and the frequency difference $\Delta f$ of the frequencies, where $\Delta f = f_1 - f_2$, is varied. In each embodiment the most intensive area of the field of vibration combinations in the material to be treated is focused by the radiators in a manner whereby it has an effect upon a desired area of the material.

15 Claims, 3 Drawing Figures

METHOD USED IN PAPER MAKING FOR TREATMENT OF A WEAVE

BACKGROUND OF THE INVENTION

The present invention relates to a method used in paper making for treatment of a weave. More particularly, the invention relates to a method used in paper making for treatment of a weave such as, for example, felt, or paper or board web being produced, and relates especially to a method for improving the maintenance of felt or the removal of water from paper or board web, or for carrying through other similar objectives.

In the method of the invention, ultrasonic sensors/-radiators (hereinafter, radiators) or similar audio frequency radiators, or series of radiators arranged in the vicinity of the material to be treated, are used. Coupling liquid is provided between the material being treated and the sensors. The coupling liquid is either special coupling liquid, preferably water, brought to the area of operation, or water eliminated from the paper or board web.

A well known method associated with paper making is the use of high frequency vibrations such as, for example, longitudinal vibrations, of ultrasonic frequency. With regard to this method, reference is made, by way of example, to the following patent literature: CH-PS No. 395,723, DE-PS Nos. 884,457; 943,029; 1,185,469 and 1,957,469, French Pat. No. 1,423 and U.S. Pat. Nos. 3,688,527; 3,829,328 and 4,191,611.

The state of the art is disclosed in an article in the Paper Trade Journal, Jan. 15, 1977, pp. 23–26.

Reference is also made to Finnish patent application No. 802180 of the present inventor; it being the objective of the present invention to further develop the method presented therein.

The state of the art more specifically related to the present invention is described in the aforementioned three patents and the article. In the state of the art described in these publications, a cleaning head, fitted with an ultrasonic vibration amplifier that functions as a radiator of longitudinal vibrations, and installed in the vincinity of the felt, is used to improve the cleaning of the felt of the wet press of a paper machine. A passive acoustic reflector is provided opposite the cleaning head. Devices are arranged before the cleaning head, on the same side. The devices convey on the felt surface liquid, which may act both as cleaning agent and as coupling liquid for ultrasonic vibrations.

In this well known technique, resonance between the cleaning head and the acoustic reflector is used in such a way that the distance between the cleaning head and the acoustic reflector, that is the length of space through which the felt being cleaned, or another weave, passes, is pitched to the length of the half-wave, or $\frac{1}{2}$ wavelength, of the acoustic vibration, or to a multiple of said half-wave length, or $n \cdot \lambda/2$. In this manner, resonance is created in which the phase of the wave reflected from the passive acoustic reflector is the same as the phase of the oncoming wave. This results in the production of such a high intensity ultrasonic field in the material being cleaned, that impurities, such as fibers, are removed from the felt or similar material.

It is now emphasized that the present invention is in no way restricted to ultrasonic frequencies. Acoustic frequencies within the auditory range may also be used in the method of the invention, provided their frequency such as, for example, several kHz, is sufficient to produce the intended effects.

In the aforementioned Finnish patent application No. 802180, the use of ultrasonic waves and longitudinal acoustic vibrations of relatively high frequency within the auditory range is presented in several different functions in the paper making process. Said patent application discloses that, in the paper making process, ultrasonic waves or vibrations of relatively high frequency within the auditory range are used in the water elimination equipment of a paper machine, in a pulp refiner, in a mixing pump for paper making pulp, in the suction box of a paper machine, and/or in the press section roll, or the like. This is accomplished by focusing, by means of parts of the aforementioned equipment, an intensive high frequency acoustic field on the paper web or on the fibers of the pulp suspension. The water removed from the paper web or pulp suspension serves as coupling liquid that conducts vibrations of acoustic frequency.

SUMMARY OF THE INVENTION

The principal object of the invention is to further extend the aforementioned uses by adding to them the use of high frequency vibrations in the cleaning of paper machine felts or similar weaves.

An object of the invention is to improve the cleaning methods and equipment disclosed in the aforementioned U.S. patents and article.

Another object of the invention is to provide a method which eliminates defects arising in practice, of which one of the most serious has been that, while using a passive reflector it has not been possible, in the direction of felt or weave, to focus the field of action of acoustic vibrations on the exact spot desired. Such focusing is, however, necessary in practice, for example, if one desires to focus a particularly strong effect of acoustic vibration on the surface parts of weaves or, in the direction of thickness of the web, on certain parts, for example, in order to control the filler distribution of the web.

In the cleaning of hard objects such as, for example, metal or plastic items, the use of ultrasonic waves has proved most effective. In the treatment and cleaning of flexible and porous materials, however, ultrasonic waves have not always provided desirable results. This has mainly been due to the elasticity and flexibility of these materials, which has resulted, among other things, in the impossibility of inducing vibrations of sufficient amplitude in the material to be cleaned or treated by means of ultrasonic waves.

In order to attain the aforementioned objectives and those hereinafter expressed, the principal characteristic feature of the method of the invention is that the acoustic radiators or series of radiators are arranged on opposite sides of the material to be treated, opposite each other. The longitudinal acoustic vibrations are fed to the different radiators, either at the same frequency or at different frequencies. While feeding vibrations of the same frequency to radiators or series of radiators placed on different sides of the material to be treated, the phase shift of vibrations fed to different radiators is varied. While using different frequencies, the frequency difference is varied so that, by regulating or setting the phase difference and/or frequency difference, such a field of vibration combinations is created in the material to be treated whose most intensive area is so focused as to have an effect on the desired region, or regions, of the material to be treated.

One of the essential advantages of the invention is that when, in accordance with the method of the invention, two acoustic radiators, preferably ultrasonic radiators, located opposite each other in such a manner that the material being treated such as, for example, felt to be put in shape or paper web to be treated, passes between them, the boundary surface friction between the surface of action of the radiators and the coupling liquid is reduced to a significant degree. This makes the method of the invention essentially more advantageous than the use of passive reflectors with a high boundary surface friction. Such reflectors may, in certain cases, and especially in the case of a paper web, render the resonance method quite unapplicable.

In the method of the invention, when ultrasonic vibrations, or audio vibrations of sufficiently high frequency, are focused on the material to be treated, the most effective area of the field where the vibrations emanating from different sources combine may be focused at a certain exact spot in the material to be treated. In this manner, the intensities of vibrations provided are essentially higher than the intensities provided by former methods and equipment. In some cases, the effect of the method of the invention is intensified by cavitation and implosion occurring in the part of the field where the influence is at its maximum. Such cavitation and implosion, for example, hammers particles of impurities out of the material to be cleaned.

On the other hand, qualities pertaining to viscosity and surface tension of the fibrous mass of paper or board web, and of the liquid therein, may essentially be altered in the method of the invention. This occurs in order to facilitate the removal of water or to control the mutual draining resistance of the fibrous mass and fillers. Thus, it occurs in the method of the invention, for example, when a homogeneous filler distribution, or such a filler distribution is aimed at, in which suitable fillers are concentrated in the vicinity of web surface.

BRIEF DESCRIPTION OF THE DRAWINGS

For a fuller understanding of the invention, reference is had to the following description taken in connection with the accompanying drawings, in which.

DESCRIPTION OF PREFERRED EMBODIMENTS

Figure 1:
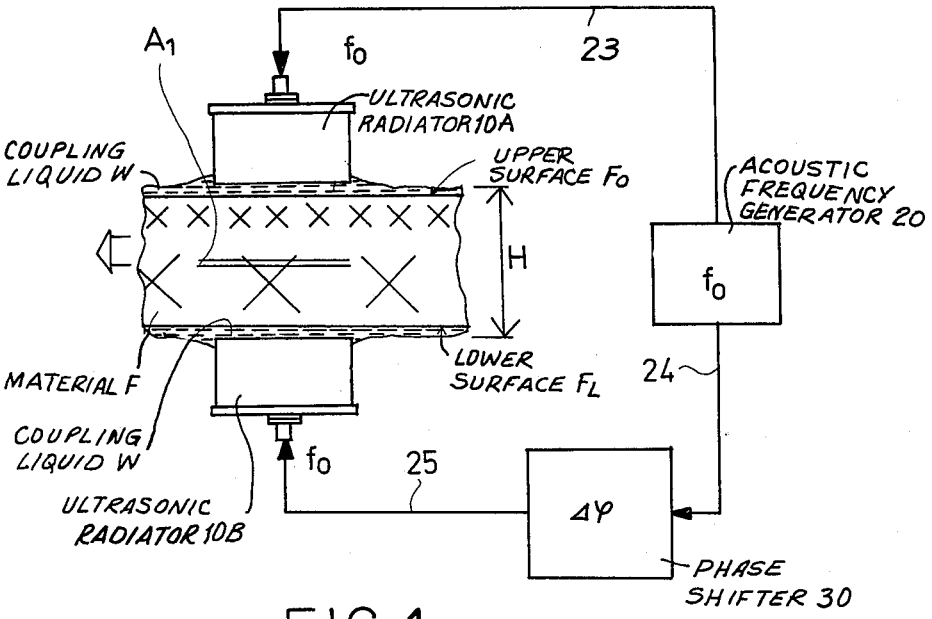
FIG. 1 is a block diagram of an embodiment of apparatus for executing the method of the invention.
Figure 2:
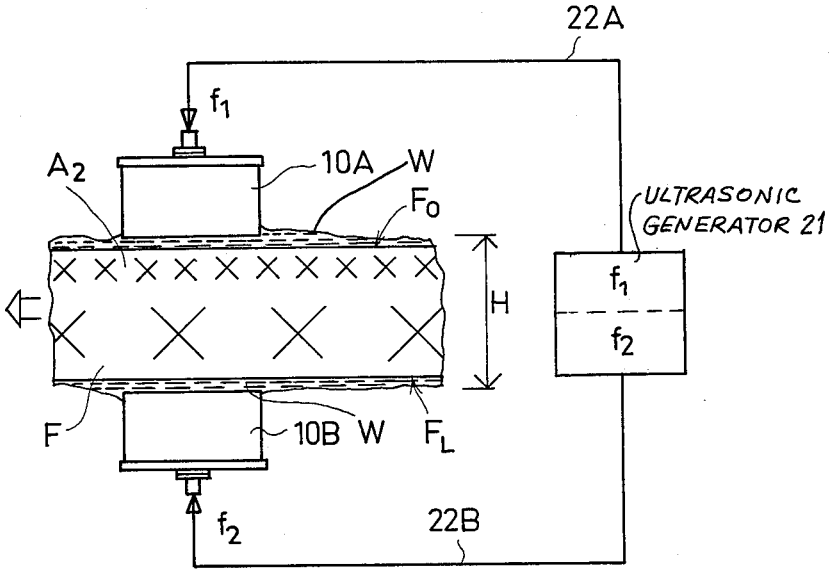
FIG. 2 is a block diagram of another embodiment of apparatus for executing the method of the invention.

In the method executed by the embodiment of FIG. 1, a single fixed ultrasonic frequency and phase shifting technique are used and in the method executed by the embodiment of FIG. 2, two different frequencies are used.

In FIGS. 1 and 2, material F to be treated such as, for example, felt or web, passes between two opposite ultrasonic radiators 10A and 10B. The ultrasonic sensors 10A and 10B may comprise, for example, piezoelectric units, or may be based on hydraulic pulsation. A plurality of such ultrasonic radiators are provided abreast and in cross-direction, for example, over the entire width of the material F to be treated. The material F to be treated may also be a wire, paper or board web supported by weave.

As shown in FIGS. 1 and 2, layers of coupling liquid W are in contact with the upper surface $F_O$ and the surface $F_L$ of the material F to be treated, to provide a sufficient acoustic coupling between said material to be treated and the ultrasonic radiators 10A and 10B. The coupling liquid W may be water in contact with the paper web, should the web not be matted yet. The coupling liquid W may be a special liquid, most naturally water, sprayed on the radiators 10A and 10B.

As shown in FIG. 1, an acoustic frequency generator 20, which produces a frequency $f_O$ is connected directly to the radiator 10A via an electrical conductor 23. The generator 20 is connected to the ultrasonic radiator 10B via an electrical conductor 24, a phase shifter 30 and an electrical conductor 25. The phase shifter 30 shifts the phase $\Delta\phi$. Thus, the ultrasonic signal of frequency $f_O$ is supplied to the radiator 10A and the ultrasonic signal of the same frequency, phase shifted, is fed to the radiator 10B.

The distance H between the operative or action surfaces of the ultrasonic sensors 10A and 10B may be also selected that a resonance and a stationary wave are created between said radiators. This is accomplished when $$H-n\cdot\lambda/2$$

wherein $\lambda=c/f_O$ and c=the velocity of sound in the medium.

The regulation of the phase shift $\Delta\phi$ by the phase shifter 30 permits the adjustment of the position $A_1$, at which the maximum encounter of two stationary waves occurs. The position $A_1$ of maximum resonance may be placed at any location in the distance H between the radiators 10A and 10B, by regulation of the phase shift $\Delta\phi$. The position $A_1$ of maximum resonance may thus be placed exactly as desired between the surfaces $F_O$ and $F_L$ of the material F to be treated.

On the other hand, the aforementioned resonance requirement $H=n\cdot\lambda/2$, when using two opposite active ultrasonic radiators 10A and 10B in accordance with the invention, is not very critical, which is an important practical advantage. The occurrance of the position $A_1$ of maximum resonance of two waves may be clarified by noting that, if, with the phase shift $\Delta\phi$, acoustic waves begin to propagate simultaneously from the radiators 10A and 10B, these waves will meet at half the distance H between the radiators. By altering the phase shift $\Delta\phi$, the point of encounter, or maximum encounter, of the waves may be adjusted at any position such as, for example, at the most dense area of the felt F which is most difficult to clean.

As shown in FIG. 2, an ultrasonic generator 21 produces ultrasonic signals having two separate or different frequencies $f_1$ and $f_2$. Each of these frequencies is fed, through the corresponding electrical conductor 22A and 22B, to the ultrasonic radiators 10A and 10B, respectively.

The difference between the different frequencies $f_1$ and $f_2$, $$\Delta f=f_1-f_2$$

The appropriate selection of $\Delta f$ permits the common maximum $A_2$ position of the two waves to sweep the material F to be treated in the direction of thickness H with the frequencies. A corresponding sweeping effect may be obtained by varying the phase shift $\Delta\phi$.

In accordance with the invention, ultrasonic frequency vibrations are preferred. It is a known fact that the frequency of ultrasonic waves is above the hearing range, whose upper limit is approximately 15–20 kHz. In some cases, it is also possible to use vibrations of acoustic frequency such as, for example, vibrations of the order of one kHz, within the auditory range.

The method of the invention may be used with particular advantage for trimming the press felt of a paper machine. One advantageous application of the method of the invention is that, in accordance with the invention, vibrations are focused, for example, on the paper web located on top of the wire, from above, and from below the wire in the phase of the process when the web has not matted yet and contains free water which acts as coupling liquid for wire roll. In such a case, vibration treatment in accordance with the method of the invention may be used, for example, to influence the distribution of the web filler by adjusting the maximum resonance $A_1A_2$ at an exact spot in the direction of thickness of the web to be treated. It is also possible in this manner to facilitate the separation of the web from the wire, or the removal of water from the web.

Radiators based on hydraulic pulsation are advantageous in applications of the invention, since their frequency may be steplessly adjusted. This is not possible with piezoelectric radiators. By being able to steplessly adjust the aforementioned frequency, radiator pairs 10A and 10B may be tuned to resonance independently of the thickness H of the material to be treated.

Figure 3:
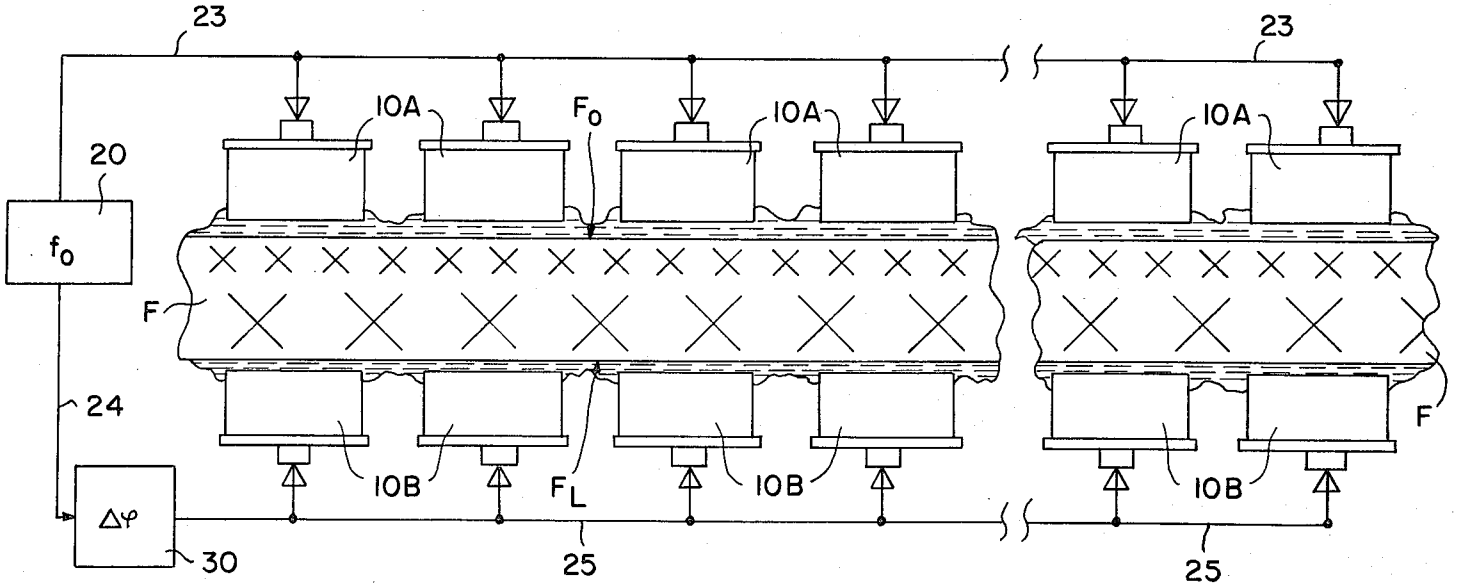
FIG. 3 is a block diagram of another embodiment of apparatus for executing the method of the invention.

As shown in FIG. 3, in some cases, radiators or series of radiators adjusted in accordance with the invention may be arranged, two or more, successively, in the passing direction of the web of weave, or other material to be treated. The distance between these successive radiators or series of radiators may be dimensioned according to the aforementioned resonance condition. In addition, the aforementioned phase difference or frequency difference technique may be used in these successive radiators or series of radiators with the object of concentrating the maximum area of the vibration field, focused from several different sources, on an appropriate and, when necessary, adjustable area in the material to be treated.

The invention is by no means restricted to the aforementioned details which are described only as examples; they may vary within the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A method used in paper making for treatment of a weave, board web, paper, and the like, said method utilizing frequency radiators arranged in the vicinity of a material to be treated and coupling liquid between the material to be treated and the radiators, said method comprising the steps of arranging frequency radiators on opposite sides of the material to be treated, opposite each other, and with a mutual spacing which is only slightly larger than the thickness of the material to be treated;

feeding longitudinal acoustic vibrations to said radiators at the same frequency;

causing said opposed radiators to apply respective acoustic vibration fields to said material to be treated located between said radiators, the respective vibration fields having the same frequency and a phase difference with respect to each other; and regulating the phase difference of the vibrations fed to the opposed radiators to focus the most intensive region of action of a combination of said fields of vibration in the thickness direction of the material to be treated.

2. A method as claimed in claim 1, wherein ultrasonic frequency radiators are arranged on opposite sides of the material to be treated.

3. A method as claimed in claim 1, wherein series of ultrasonic frequency radiators are arranged on opposite sides of the material to be treated.

4. A method as claimed in claim 1, wherein each of said radiators has an action surface and the sensors on opposite sides of said material are spaced from each other at a distance H between their action surfaces which substantially fulfills the resonance condition $$H=n\cdot\lambda/2$$

where n is an integer, $\lambda=c/f$, c=the velocity of sound in the material to be treated and f=the frequency of vibration.

5. A method as claimed in claim 1, wherein two series of ultrasonic radiators are arranged on opposite sides of the material to be treated and each of said series of radiators extends transversely across the passing direction of the material to be treated.

6. A method used in paper making for treatment of a weave, board web, paper, and the like, said method utilizing frequency radiators arranged in the vicinity of a material to be treated and coupling liquid between the material to be treated and the radiators, said method comprising the steps of arranging frequency radiators on opposite sides of the material to be treated, opposite each other, and with a mutual spacing which is only slightly larger than the thickness of the material to be treated;

feeding longitudinal acoustic vibrations to said radiators at different frequencies $f_1$ and $f_2$;

causing said opposed radiators to apply respective acoustic vibration fields to said material to be treated located between said radiators, the respective vibration fields having different respective fequencies $f_1$ and $f_2$; and regulating the frequency difference $\Delta f$ of said frequencies, where $\Delta f=f_1-f_2$, to focus the most intensive region of action of a combination of said fields of vibration in the thickness direction of the material to be treated.

7. A method as claimed in claim 6, wherein ultrasonic frequency radiators are arranged on opposite sides of the material to be treated.

8. A method as claimed in claim 6, wherein series of ultrasonic frequency radiators are arranged on opposite sides of the material to be treated.

9. A method as claimed in claim 6, wherein each of said radiators has an action surface and the sensors on opposite sides of said material are spaced from each other at a distance H between their action surfaces which substantially fulfills the resonance condition $$H=n\cdot\lambda/2$$

where n is an integer, $\lambda=c/f$, c=the velocity of sound in the material to be treated and f=the frequency of vibration.

10. A method as claimed in claim 6, wherein two series of ultrasonic radiators are arranged on opposite sides of the material to be treated and each of said series of radiators extends transversely across the passing direction of the material to be treated.

11. Paper making apparatus for treatment of a weave, board web, paper, and the like, said apparatus comprising frequency radiators positioned on opposite sides of a material to be treated, opposite each other, and with a mutual spacing which is only slightly larger than the thickness of the material to be treated;

a frequency generator having a first terminal electrically connected to one of said frequency radiators on one side of said material and a second terminal, said generator producing longitudinal acoustic vibrations at said first and second terminals of the same frequency; and a phase shifter connecting the second terminal of said frequency generator to another of said frequency radiators on the opposite side of said material for varying the difference of the vibrations fed to said radiators for focusing the most intensive area of a field of vibration combinations in said material in a manner whereby it has an effect upon a desired area of said material.

12. Paper making apparatus as claimed in claim 11, wherein said radiators consist of series of ultrasonic frequency sensors.

13. Paper making apparatus as claimed in claim 11, wherein each of said radiators has an action surface and the sensors on opposite sides of said material are spaced from each other at a distance H between their action surfaces which substantially fulfills the resonance condition $$H=n\cdot\lambda/2$$

where n is an integer, $\lambda=c/f$, c=the velocity of sound in the material to be treated and f= the frequency of vibration.

14. Paper making apparatus for treatment of a weave, board web, paper, and the like, said apparatus comprising frequency radiators on opposite sides of a material to be treated, opposite each other, and with a mutual spacing which is only slightly larger than the thickness of the material to be treated; and an ultrasonic frequency generator having a first terminal electrically connected to one of said frequency radiators on one side of said material and a second terminal electrically connected to another of said frequency radiators on the opposite side of said material, said generator producing longitudinal acoustic vibrations of a first frequency $f_1$ at its first terminal and of a different second frequency $f_2$ at its second terminal, and means for regulating the frequency difference $\Delta f$ of said frequencies, $\Delta f=f_1-f_2$, to thereby focus the most intensive area of the field of vibration combinations in said material to be treated in a manner whereby it has an effect upon a desired area of said material.

15. Paper making apparatus as claimed in claim 14, wherein two series of ultrasonic radiators are arranged on opposite sides of the material to be treated and each of said series of radiator extends transversely across the passing direction of the material to be treated.

* * * * *